United States Patent [19]

Scott

[11] Patent Number: 4,719,056

[45] Date of Patent: Jan. 12, 1988

[54] FLUID TREATMENT

[75] Inventor: Alistair Scott, Cambridge, United Kingdom

[73] Assignee: Isoworth Limited, England

[21] Appl. No.: 747,553

[22] Filed: Jun. 21, 1985

[30] Foreign Application Priority Data

Jun. 25, 1984 [ZA] South Africa ..... 102/84

[51] Int. Cl.[4] ..... B01F 3/04

[52] U.S. Cl. ..... 261/80; 261/81; 261/92; 261/DIG. 7; 222/129.2

[58] Field of Search ..... 261/DIG. 7, 80, 92; 222/129.2; 261/81

[56] References Cited

U.S. PATENT DOCUMENTS

| | | | |
|---|---|---|---|
| 149,135 | 3/1874 | Knight | 261/92 |
| 358,165 | 2/1887 | Raydt | 261/DIG. 7 |
| 602,938 | 4/1898 | Gaines | 261/DIG. 7 |
| 1,332,945 | 3/1920 | Holderle et al. | 261/DIG. 7 |
| 1,528,204 | 3/1925 | Greenawalt | 261/92 |
| 1,778,571 | 10/1930 | Stratton | 261/92 |
| 1,782,511 | 11/1930 | Neuschafer et al. | 261/DIG. 7 |
| 1,862,089 | 6/1932 | Kantor | 261/DIG. 7 |
| 1,904,952 | 4/1933 | Russell | 261/92 |
| 1,929,948 | 10/1933 | Kantor | 261/DIG. 7 |
| 1,929,949 | 10/1933 | Kantor | 261/DIG. 7 |
| 2,077,850 | 4/1937 | Painter | 261/19 |
| 2,391,003 | 12/1945 | Bowman | 261/DIG. 7 |
| 2,393,941 | 1/1946 | Stewart | 261/DIG. 7 |
| 2,588,677 | 3/1952 | Welty et al. | 261/DIG. 7 |
| 2,737,376 | 3/1956 | Haglund . | |
| 3,347,421 | 10/1967 | Yingst et al. | 261/DIG. 7 |
| 3,398,550 | 8/1968 | Lents . | |
| 3,472,425 | 10/1969 | Booth et al. | 261/DIG. 7 |
| 3,664,550 | 5/1972 | Carothers et al. | 222/129.2 |
| 3,685,810 | 8/1972 | Calcote | 261/81 |
| 3,726,102 | 4/1973 | Parks | 261/DIG. 7 |
| 3,747,904 | 7/1973 | Gross | 261/92 |
| 3,756,473 | 9/1973 | Donahue, Jr. | 222/129.2 |
| 4,290,885 | 9/1981 | Kwak . | |
| 4,509,569 | 4/1985 | Adolfsson | 261/DIG. 7 |
| 4,518,541 | 5/1985 | Harris | 261/DIG. 7 |

FOREIGN PATENT DOCUMENTS

| | | | |
|---|---|---|---|
| 26493 | 4/1981 | European Pat. Off. . | |
| 84316 | 1/1983 | European Pat. Off. . | |
| 104099 | 4/1898 | Fed. Rep. of Germany . | |
| 1157701 | 7/1969 | United Kingdom . | |
| 1457691 | 12/1976 | United Kingdom . | |
| 1546401 | 5/1979 | United Kingdom . | |
| 2013096 | 8/1979 | United Kingdom | 261/DIG. 7 |

*Primary Examiner*—Tim Miles

*Attorney, Agent, or Firm*—Lerner, David, Littenberg, Krumholz & Mentlik

[57] ABSTRACT

A carbonation method and apparatus is described in which carbonation is achieved by forcing carbon dioxide in gaseous form from an atmosphere thereof downwardly into a body of water to be carbonated. This may be achieved by a vaned rotor rotatable about a horizontal axis or other means. The carbon dioxide atmosphere is preferably maintained at a pressure of about 100 psig (6.8 bars). The degree of carbonation may be varied by varying the time for which the carbonation operation is carried on. A flavor concentrate supply means, containing various flavors, is pressurized for the supply of the concentrate utilizing what would otherwise be waste carbon dioxide gas from the carbonation chamber after completion of the carbonation operation.

33 Claims, 27 Drawing Figures

12
64
66
16
56
50
54
48
52
46
62
60
58
36
42a
42b
44
38a
38b
18
20
26
29
40a
40b
28
32
31
A
W
24
70
V3
S2
V2
22
10
30
14
V1
S1

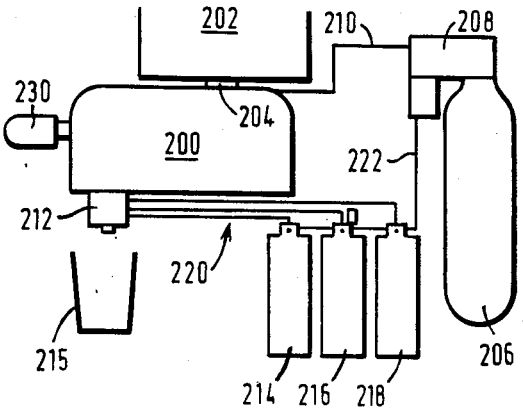
FIG. 15
FIG. 16
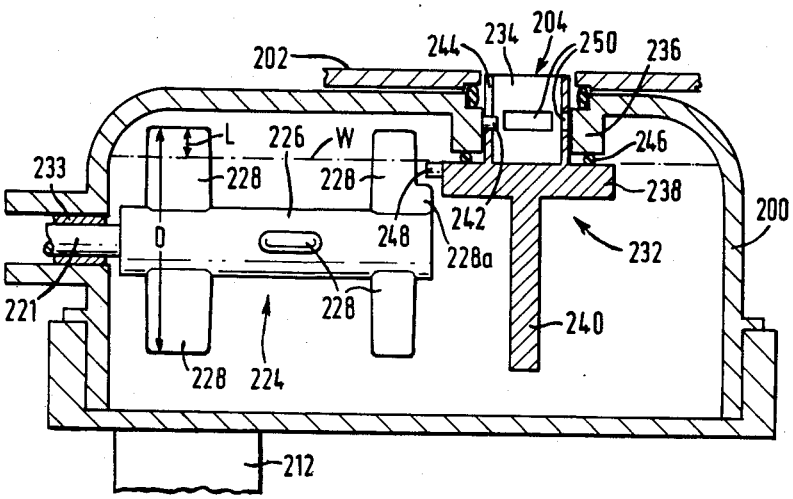
FIG. 17
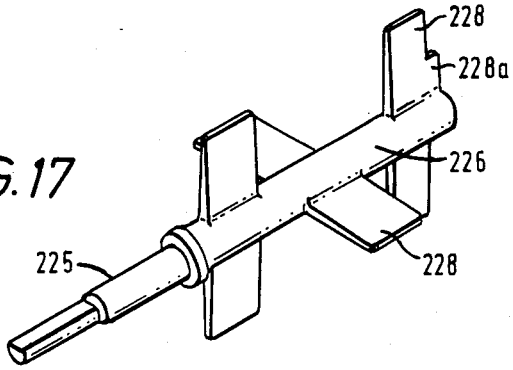

FLUID TREATMENT

This invention relates to fluid treatment. More particularly, the invention concerns apparatus and method for carbonating water and/or for dispensing flavoured drinks, especially carbonated drinks.

CARBONATION

Known methods of carbonating water fall into two groups. In one group, the carbon dioxide gas is injected into the water to be carbonated at a low level so that it forms bubbles which float up through the water to the surface so that carbon dioxide in the bubbles becomes absorbed in the water. This method has been widely used. For example, it is common practice to utilize this method in relatively small carbonating apparatus for home use and operable for dispensing carbonated water in quantities sufficient to form one drink. Examples of apparatus utilizing the injection method of carbonation can be seen in UK patent specification No. 412,849 (Schwendimann) and U.S. Pat. No. 2,826,401 (Peters). Both Schwendimann and Peters provide injectors which are rotatable and which have laterally directed members at their bottom end to assist in the mixing of the carbon dioxide gas with the water. The main problem with the injection method of carbonation is that it is only effective if relatively high pressures are used so that, during carbonation, the carbonation chamber is pressurized to a relatively high level. Typically, for example, pressures of 170 psig (11.6 bars) may be involved.

The second group of known methods for achieving carbonation involves spraying or atomizing the water in an atmosphere of carbon dioxide gas. In these methods, a carbonation chamber may be prefilled with carbon dioxide gas and the water introduced into the chamber by spraying. Alternatively, or in addition, when the carbonation chamber has been partly filled with water, the water may be drawn upwardly and sprayed into the carbon dioxide atmosphere above the water level in the chamber. In this method, carbon dioxide is dissolved into the water droplets in the spray and the droplets carry the carbon dioxide in dissolved form into the body of the water to effect carbonation. Typical proposals for achieving carbonation by this method are disclosed in U.S. Pat. No. 2,306,714 (Rowell) and U.S. Pat. No. 2,391,003 (Bowman). A major problem with these methods also is that they require the carbonation chamber to be pressurized to a relatively high level similar to that mentioned above. Also these methods are slow, so that a long time is required to achieve an adequate degree of carbonation.

One of the objects of the present invention, therefore, is to provide an improved method and apparatus for carbonation.

According to one aspect of the present invention, a carbonation method is provided in which a carbonation chamber is partly filled with water and an atmosphere comprising carbon dioxide is provided above the level of water in the chamber, the method comprising continuously or repeatedly drawing or forcing gas from said atmosphere down into the water.

In another aspect, the invention provides carbonation apparatus comprising a carbonation chamber adapted to be partially filled with water and to contain an atmosphere comprising carbon dioxide above the level of water in the chamber, and means for continuously or repeatedly drawing or forcing gas from said atmosphere down into said water.

In a further aspect, the invention provides carbonation apparatus comprising a carbonation chamber adapted to be partially filled with water and to contain an atmosphere including carbon dioxide in the space above said water, and a movable member, preferable a rotatable member, which in operation moves repeatedly between said atmosphere and said water so as to cause gas from said atmosphere to be moved downwardly into said water.

According to a further aspect, the present invention provides carbonation apparatus comprising a carbonation chamber adapted to be partially filled with water and to contain an atmosphere including carbon dioxide gas in a space above the water, and a member which is rotatable about a non-vertical axis and has a plurality of vanes. Preferably, the axis of rotation is horizontal.

It has been found that carbonation may be achieved in accordance with the preferred aspects of the invention as defined above without the need for high pressures. Typically, pressures of around 100 psig (6.8 bars) are adequate but lower pressures, for example down to 60 psig (4.1 bars) may be used. The invention is particularly applicable to apparatus for use in the home in which the capacity of the chamber is such that the quantity of water carbonated in each carbonation operation is sufficient for one drink.

Applicants acknowledge U.S. Pat. No. 3,044,878 (Knedlik) which discloses an apparatus for producing semi-frozen beverages. The apparatus illustrated in the drawings of the patent comprises a cylindrical chamber arranged with its axis horizontal. Water which has been pre-mixed with flavouring concentrate and carbon dioxide is introduced into the chamber so as to substantially fill it and the liquid in the chamber is maintained at a temperature which is below its freezing point. To prevent formation of ice particles, a vaned rotor is provided in the chamber with its axis horizontal. The rotor extends from end to end of the chamber and the vanes extend to positions close to the internal cylindrical walls of the chamber so as to stop the formation of ice particles on those walls. The rotor is driven to provide vigorous and continuous agitation. Since the liquid substantially fills the chamber and since the rotor extends substantially from end to end and to positions close to the peripheral wall of the chamber, the liquid in the chamber will be swept around, and in contact with, the cylindrical internal wall of the chamber. Accordingly, there will be no discernable $CO_2$ atmosphere above the water in the chamber and the vanes of the rotor will not function to force $CO_2$ from an atmosphere thereof down into the water as in a preferred form of the present invention. Further, in Knedlik the rotor is driven continuously both when the apparatus is in the "idling" state and when beverage is being discharged, at which time the liquid in the chamber is simultaneously replenished to keep the chamber full. In the preferred form of the present invention, the carbonation process is stopped prior to discharge of the carbonated liquid, the chamber being emptied at this point, because agitation of the liquid as it is leaving the chamber would tend to cause de-carbonation. The Knedlik apparatus is intended for commercial use in which continuously available beverage is provided and is not suitable for home use in view of its complexity and high cost. Applicants also acknowledge that Knedlik states that $CO_2$ and water might be introduced via separate conduits into his chamber but even with this modification the function of the rotor in Knedlik will not be changed and there will be no discernable $CO_2$ atmosphere above the water level.

DISPENSING

Normally, carbonated drinks are mixed with a flavoured concentrate (syrup). Desirably, therefore carbonation apparatus, in addition to being provided with means for carbonating water, should also be provided with means for dispensing a selected concentrate and mixing that concentrate with the carbonated water. A known method of dispensing the concentrate involves supplying the vessel containing the concentrate with carbon dioxide under pressure from the carbon dioxide supply tank so that a required quantity of concentrate is forced out of the container to a dispensing nozzle from which it may be discharged into a glass for mixing with the carbonated water. The above mentioned U.S. Pat. No. 2,391,003 (Bowman) illustrates this method. The disadvantage of the method is that carbon dioxide is wasted.

In another aspect, the invention is concerned with an improved method of dispensing concentrate.

According to a further preferred aspect of the present invention, carbonation apparatus comprises a carbonation chamber for receiving water and carbon dioxide gas and concentrate dispensing means which utilizes gas from the carbonation chamber, after a carbonation operation, for causing a movement of said concentrate to enable said concentrate to be dispensed. preferably, said concentrate is moved directly from a concentrate container to a discharge nozzle under said pressure of gas from said carbonation chamber.

In another preferred aspect, the invention provides a carbonation method and apparatus in which, to achieve carbonation, a carbonation chamber is pressurized and in which the pressure in said carbonation chamber is utilized to cause movement of concentrate towards a dispensing nozzle. In a preferred form, the upper part of the carbonation chamber is connected to an upper part of a concentrate container through a valve so that, upon opening of the valve, the concentrate container becomes pressurized.

In this way, concentrate may be dispensed without wasting fresh carbon dioxide i.e. carbon dioxide direct from the carbon dioxide tank.

Applicants acknowledge U.S. Pat. No. 3,809,292 (Booth) which discloses a commercial carbonation apparatus in which a supply of carbonated beverage is continuously available. Water is carbonated in a carbonation chamber by the injection method as previously described. The water partly fills the chamber and the chamber is maintained at a high pressure. Pressure from the chamber is supplied to concentrate containers for pressurizing them for discharging the concentrate. However, in this disclosure, the carbonation chamber is not depressurized at the end of a carbonation operation and thus this patent fails to disclose the concept of using otherwise waste $CO_2$ for pressurizing the concentrate containers.

CONCENTRATE SELECTION

Preferably, carbonation apparatus should include a number of concentrate containers for containing respectively concentrates of different flavours. In prior proposed apparatus the containers are connected to outlet orifices for the discharge of the concentrate via electromagnetically operated valves. Selection is made by actuating the appropriate valve. Such arrangements are relatively expensive.

According to a further preferred aspect of the present invention, a concentrate selector arrangement comprises a number of valves, a manually movable member for effecting selection, and mechanical means for actuating the valve according to the position of the selector member.

In a preferred form, the selector member or a part thereof, it utilized to transmit movement from an actuating member to the selected valve. The actuating member may be so arranged that when a glass is positioned to receive carbonated water and concentrate, the actuator member is operated to cause dispensing.

In a preferred form, a carbonated drink dispensing device comprises an actuating member which upon movement opens both a first valve for the discharge of carbonated water and a selected one of a plurality of further valves for the discharge of a selected concentrate, a movable selector member being provided for selecting the further valve to be opened. In a preferred form, the selector member is attached to a part of the first valve so that the first valve and the selected further valve are opened at approximately the same time.

CONCENTRATE CONTROL

Concentrates of different flavour generally have different viscosities and accordingly there is need to control the quantity of concentrate dispensed. The present invention provides, in a further preferred aspect, a carbonation apparatus capable of dispensing selectively different ones of a plurality of concentrates, the means for dispensing the concentrates including different conduits for transporting the concentrates from respective concentrate containers to a discharge point, at least one of said conduits having a bore of different cross-sectional area to the other or at least one of the others to compensate for differences in viscosity between the concentrates. With this arrangement, it is possible to utilize the same pressure for discharging each of the concentrates whilst metering the amount of concentrate dispensed.

The invention is described further by way of the accompanying drawings in which:

FIG. 15 is a diagram of a carbonation apparatus according to a further embodiment of the present invention;

FIG. 16 is a diagrammatic section through a carbonation chamber included in the apparatus of FIG. 15;

FIG. 17 is a perspective view of a rotor included in the apparatus of FIGS. 15 and 16;

Figure 1:
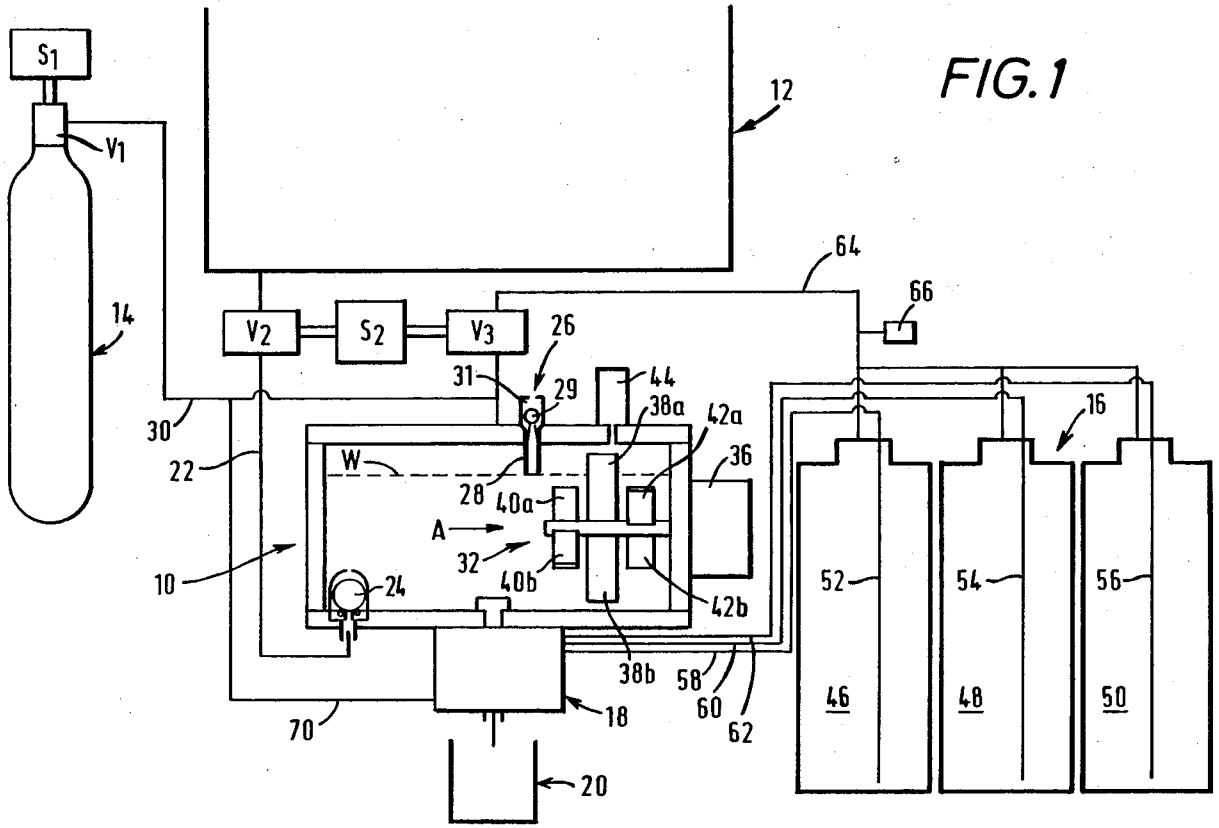
FIG. 1 is a diagram showing apparatus according to a preferred embodiment of the present invention.

With reference to FIG. 1, the carbonation apparatus comprises a carbonation chamber 10, a water supply tank 12, a carbon dioxide supply tank 14 and concentrate supply arrangement 16. A valve unit 18 is disposed on the bottom of the chamber 10 for dispensing both carbonated water from the chamber 10 and a selected concentrate from the arrangement 16 into a glass 20.

CARBONATION

Water is supplied from the tank 12 to the chamber 10 through a valve $V_2$ controlled by a solenoid $S_2$, a conduit 22 and a ball valve 24 located inside the chamber 10. A vent 26 connected to the interior of the chamber 10 by means of a pipe 28 permits air in the chamber 10 to be vented to atmosphere while the chamber 10 is being filled with water. The pipe 28 projects down into the chamber 10 a distance which is such that its lower end is imersed in the water when the chamber 10 has been filled with water to the required level indicated by W.

Carbon dioxide is supplied from container 14 through valve $V_1$, controlled by a solenoid $S_1$, and a conduit 30 leading into the chamber 10 at the top.

A ball 29 located in the vent 26 is arranged to close the vent if water is forced up the pipe 28 due to pressurization of the chamber. For this purpose, the ball is movable upwardly into sealing engagement with a valve seat 31 at the top of the vent. The ball 29 is also arranged so that it closes the vent, in response to increasing gas pressure in the chamber 10, if carbon dioxide is introduced into the chamber 10 with the water level below the lower end of the pipe 28 so that carbonation may be achieved in these circumstances.

A paddle 32 is mounted inside the chamber 10 for rotation about a horizontal axis, being carried on the shaft 34 of a motor 36 which is mounted on the outside of the chamber 10. The shaft 34 may project through an opening (not shown) in the wall of the chamber 10 with an appropriate seal being provided. Alternatively, the shaft 34 could be connected to the motor 36 by a magnetic coupling.

Figure 2:
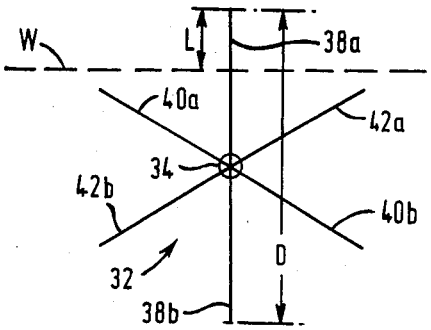
FIG. 2 is a view in the direction of the arrow A of FIG. 1 showing a part of the apparatus.

The paddle 32 comprises three pairs of vanes 38*a*, 38*b*; 40*a*, 40*b* and 42*a*, 42*b*. The two vanes of each pair (e.g. 38*a* and 38*b*) are mounted directly opposite each other on the shaft 34. The vanes 40*a* and 40*b* are mounted on the shaft 34 to one side of the vanes 38*a* and 38*b* and at a different angle relative thereto; and the vanes 42*a* and 24*b* are mounted on the shaft 34 at the other side of the vanes 38*a* and 38*b* and again at a different angle to the other vanes. These angles are such that the six vanes are equi-angularly spaced around the shaft 34. The angular position of the shaft 34 shown in FIGS. 1 and 2 is such that the vanes 38*a* and 38*b* are vertical and, as can be seen from these figures, the vane 38*a* projects above the water level W almost to the top of the chamber 10 whereas the vane 38*b* projects almost to the bottom of the chamber 10 in this position. In FIG. 2, L indicates the length of the portion of each vane which projects above the water level W when the vane is in its uppermost position with the paddle stationary and the apparatus horizontal and D indicates the diameter of the circle swept by the tip of each vane as the paddle rotates. L should be at least 5% of D and preferably greater than 12% of D. It is particularly preferred that L should be from 12% to 15% of D for achieving optimum carbonation. As the paddle 32 rotates, the vanes move from within the water, into the space above the water level, and back into the water.

In operation, the chamber 10 is partially filled with water up to the level W. Thereafter, carbon dioxide is admitted to the space above the level of water in the chamber 10 by opening the valve $V_1$. A pressure switch 44 senses the gas pressure in the chamber 10. When this reaches the required level preferably in the range 60 to 140 psig (9.6 bars), for example 100 psig (6.8 bar), the solenoid is actuated to close the valve $V_1$. The ball valve 24 prevents water being forced back up the conduit 22 due to the pressure in the chamber 10. After the pressure has reached the required value, the motor 36 is energized to cause the paddle 32 to rotate. Typically, this rotation may be at a speed from 500 to 2000 rpm, preferably within the range 1000 to 1500 rpm. This rotation is continued for several seconds, for example 5 seconds, during which carbonation of the water takes place. The degree of carbonation may be varied by varying the time for which the paddle is driven and/or by varying the pressure of the atmosphere containing carbon dioxide in the space in the chamber 10 above the water level.

Figure 3:
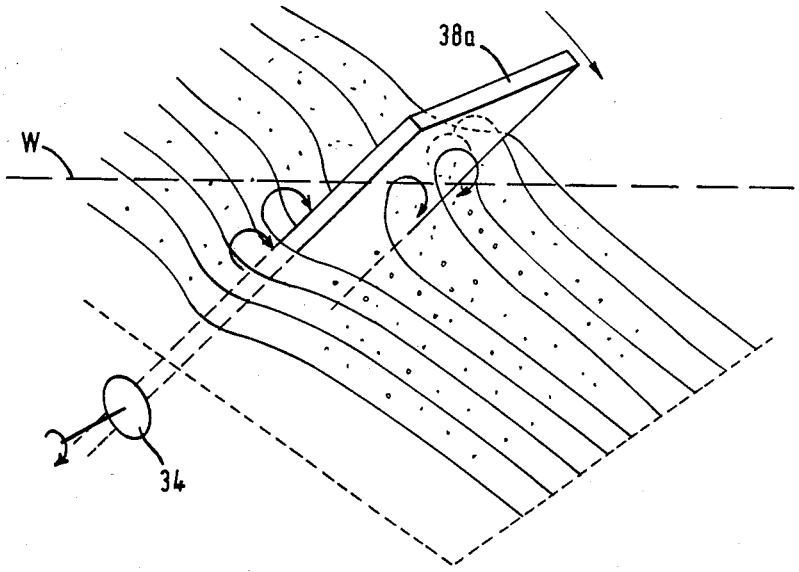
FIG. 3 is a diagram showing how carbonation is achieved in the apparatus of FIGS. 1 and 2.

The action of the paddle is to force the gas in the space above the water level down into the water. As much gas as possible should be forced into the water and it should be carried to a level which is as deep as possible. To achieve these purposes, the vanes are dimensioned, as discussed above, such that they reach nearly to the top and nearly to the bottom of the chamber 10. Also, therefore, the paddle acts to shift water from the bottom portion of the chamber 10 to a higher level so that water at all levels may be uniformly carbonated. Further, the paddle creates intense agitation of the water causing it to be splashed up into the atmosphere of carbon dioxide thereby to assist with carbonation and thereby also achieving uniform carbonation. As can be seen in FIG. 3, each vane, in addition to forcing carbon dioxide in gaseous form in front of it into the water, creates a vortex behind it which draws carbon dioxide in gaseous form in and causes the gas to be carried down into the water. FIG. 3 shows the fluid flow lines created by the vane as it moves. It can be seen from FIG. 1, that the paddle 32 is located to one side of the chamber 10, which is preferably of circular cross-section as seen in plan view. With this arrangement, the water in the chamber 10 is also caused to rotate around the chamber 10 so that, as the paddle is driven, different portions of the body of water in the chamber 10 move past the paddle to be subjected to the carbonation action.

As carbonation progresses, gas from the space above the water level in the chamber 10 is absorbed by the water so that the gas pressure reduces. This is sensed by the pressure switch 44 and, when the pressure drops below a certain level, say a drop of 5 psig (0.3 bars), the valve $V_1$ is again opened to admit more carbon dioxide to the chamber 10.

CONCENTRATE DISPENSING

The concentrate dispensing arrangement 16 comprises three containers 46, 48 and 50 containing concentrates of different flavours. Dip tubes 52, 54 and 56 extend into the respective containers 46, 48 and 50 almost to the bottom and are connected via respective conduits 58, 60 and 62 to the valve unit 18 for supplying concentrate from the containers to the valve unit. The upper part of each of the containers 46, 48 and 50 is connected by a conduit arrangement 64 to the upper part of the chamber 10. A valve $V_3$ is located in the conduit arrangement 64 and is controlled by the solenoid $S_2$. After completion of the carbonation operation in the chamber 10, the valve $V_3$ is opened to permit the upper parts of the containers 46, 48 and 50 to be pressurized utilizing the gas in the upper part of the chamber 10. A pressure relief valve 66 connected to the conduit arrangement 64 limits the pressurization of the containers 46, 48 and 50 to a predetermined value, say 2 psig (0.1 bars). Thus, each of the containers 46, 48 and 50 is pressurized to the same value and this pressurization exerts a force on the concentrate in the containers which is sufficient to dispense each concentrate from its respective container. Since concentrates have different viscosities, the bore of the dip tubes 55, 54 and 56 and/or that of the conduits 58, 60, 62 is selected to ensure that the required amount of concentrate will be dispensed. Merely by way of example, if Coca Cola is to be dispensed, the bore of the dip tube and connecting conduit may be 6 mm, if lemonade is to be dispensed it may be 3 mm, if tonic is to be dispensed it may be 3 mm also.

CARBONATED WATER DISCHARGE AND CONCENTRATE SELECTION

The valve unit 18, the details of which are illustrated in FIGS. 4 to 7, provides three functions. First, it relieves the pressure in the carbonation chamber 10. Second, it permits selection of which of the concentrates from the containers 46, 48 and 50 is to be dispensed and it dispenses the selected concentrate. Third, it dispenses carbonated water from the chamber 10.

For relieving the pressure in the carbonation chamber 10, the valve unit 18 comprises an exhaust valve 68 which is connected to the upper part of the chamber 10 by a conduit 70 and part of the conduit 30. The exhaust valve 68 includes a vertically movable valve member 68*a* which is spring urged to its upper, closed position. An actuating lever 72 has one end 72*a* pivotally connected to the valve member 68*a* for pushing the valve member 68*a* downwards to open the valve 68 thereby permitting gas in the upper part of the chamber 10 to be exhausted to atmosphere through the conduits 30 and 70 and the valve 68.

The actuating lever 72 comprises an upper arm 72*b* and a downwardly directed arm 72*c*. The lever 72 is attached by a pivot 72*d*, intermediate the ends of the upper arm 72*b*, to a hollow cylindrical sleeve 74 which is mounted for vertical sliding movement in an aperture in the base 10*a* of the chamber 10. The sleeve 74 forms a valve for permitting discharge of carbonated water from the chamber 10 and for this purpose has got lateral openings 74*a* near its upper end and a head 74*b* which carries a seal 76 which engages the inside surface of the bottom wall 10*a* of the chamber 10 when the sleeve 74 is in its lower position so that at this time water cannot escape from the chamber 10.

Figure 4:
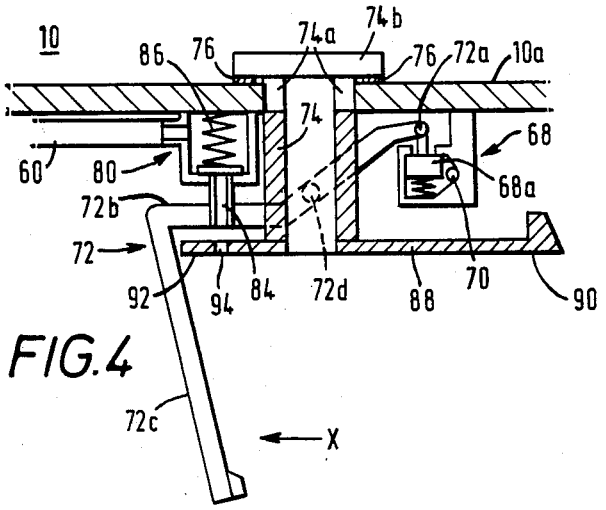
FIG. 4 is a sectional view showing part of a valve unit included in the apparatus of FIG. 1, and shows the valve unit in its closed position.
Figure 5:
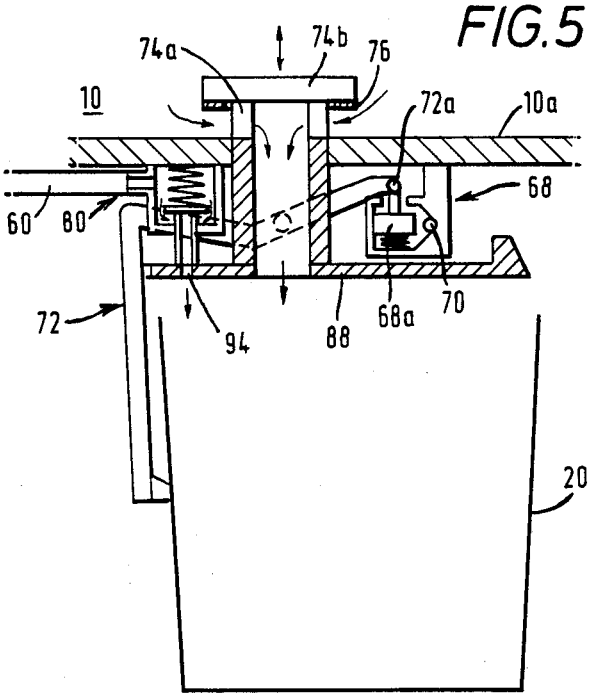
FIG. 5 is a view similar to FIG. 4 but showing the valve unit in its open position.

At completion of carbonation, the chamber 10 is pressurized so that the valve head 76 is pressed firmly against the inside surface of the bottom wall 10*a* of the chamber 10. Consequently, if the downwardly directed arm 72*c* of the lever 72 is moved to the left as shown by the arrow X in FIG. 4, the lever 72 rotates about the pivot 72*d*, the sleeve 74 remaining stationary, so that the valve 68 is opened, thus relieving the pressure in the chamber 10. Continued movement of the arm 72*c* in the direction of arrow X in FIG. 4 will cause the lever to pivot about its end 72*a*, so that the sleeve 74 slides upwardly to the position shown in FIG. 5, in which position the sleeve valve 74 is opened to permit carbonated water to be discharged from the chamber 10. The actuating member 72 is designed so that its lower arm 72*c* is arranged to be engaged by the glass 20 when placed in position so that as the glass 20 is moved to the left relative to the valve unit as seen in FIGS. 4 and 5, first of all the valve 68 is opened, the sleeve 74 being held stationary by the pressure in the chamber 10, and thereafter, when the pressure in the chamber 10 has been relieved, the sleeve 74 moves upwardly to discharge carbonated water through the opening 74*a* and the sleeve 74 into the glass 20.

Figure 6:
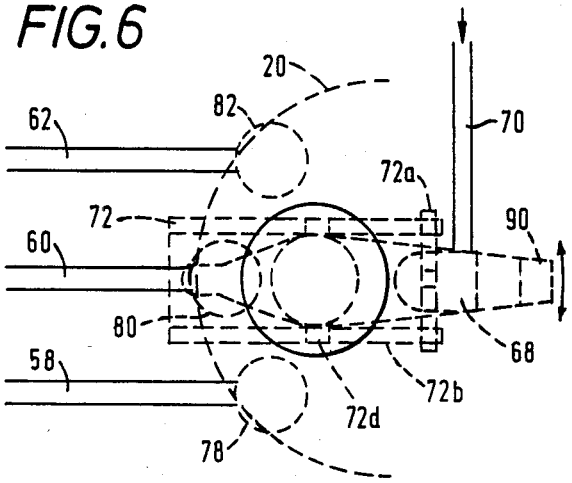
FIG. 6 is a plan view showing part of the valve unit of FIGS. 4 and 5.
Figure 7:
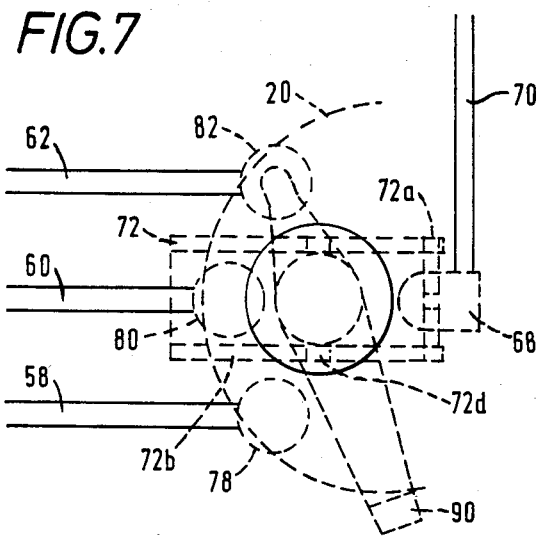
FIG. 7 is a plan view similar to FIG. 6, but showing a concentrate selector element in a different position.

The valve unit 18 includes three concentrate dispensing valves 78, 80 and 82 connected respectively to the conduits 58, 60 and 62. The valves 78, 80 and 82, are of essentially identical construction. As seen in FIGS. 4 and 5, the valve 80 comprises a vertically movable valve member 84 urged downwardly by a spring 86 to the closed position (FIG. 4). A concentrate selector bar 88 is secured to the lower end of the sleeve 74 which is rotatable about its axis (which is vertical). One end of the sleeve 88 carries a nob or finger grip 90 for effecting this rotation so as to position the opposite end 92 beneath a selected one of the valves 78, 80 or 82. FIG. 6 shows the end 92 of the bar 88 beneath the valve 80 and FIG. 7 shows it beneath the valve 82. Thus, when the sleeve 74 is raised by actuation of the lever 72 so as to discharge carbonated water into the glass 20, the selected one of the valves 78, 80 and 82 is engaged by the end 92 of the bar 88 so as to open the valve by virtue of its valve member 84 being raised. The construction of the valve member 84 is similar to that of sleeve 74 i.e. it is hollow and is provided with lateral apertures so that the selected concentrate is discharged through the selected valve member 84 and through an aperture 94 in the bar 82 and into the glass 20. As indicated above, this discharge of concentrate takes place due to the pressure introduced into the upper parts of the concentrate containers.

To avoid possible contamination of one concentrate with another, separate apertures 94 may be provided in the bar 88 for the different valves, this of course requiring appropriate positioning of the apertures and the valves 78, 80 and 82. Alternatively the aperture 94 could be sufficiently large to ensure that concentrate flows through the aperture 94 without contacting the edges thereof thus avoiding contamination: of course in this case means must be provided to ensure that the bar 88 engages the valve member 84 for the purpose of opening the associated valve. As a further alternative, the valve members 84 could have a nozzle portion which project down through the apertures 90 to ensure that the aperture 94 does not become contaminated.

Control and Timing

Figure 8:
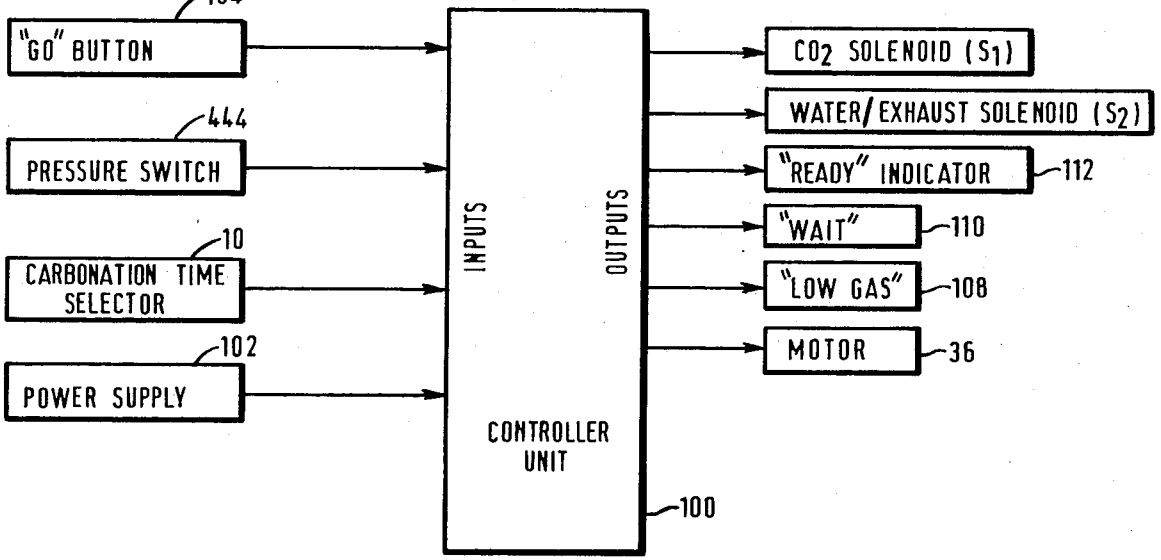
FIG. 8 is a block diagram illustrating a controller unit included in the apparatus of FIG. 1.
Figure 9:
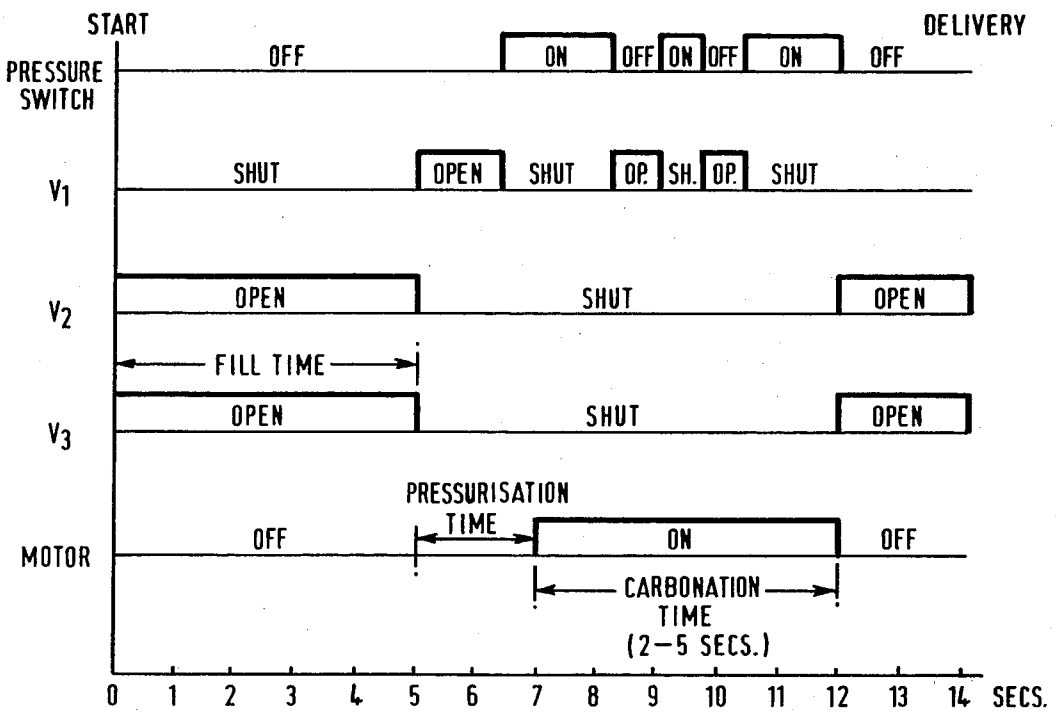
FIG. 9 is a timing chart showing the timing of various operations performed under control of the controller unit of FIG. 8.
Figure 10:
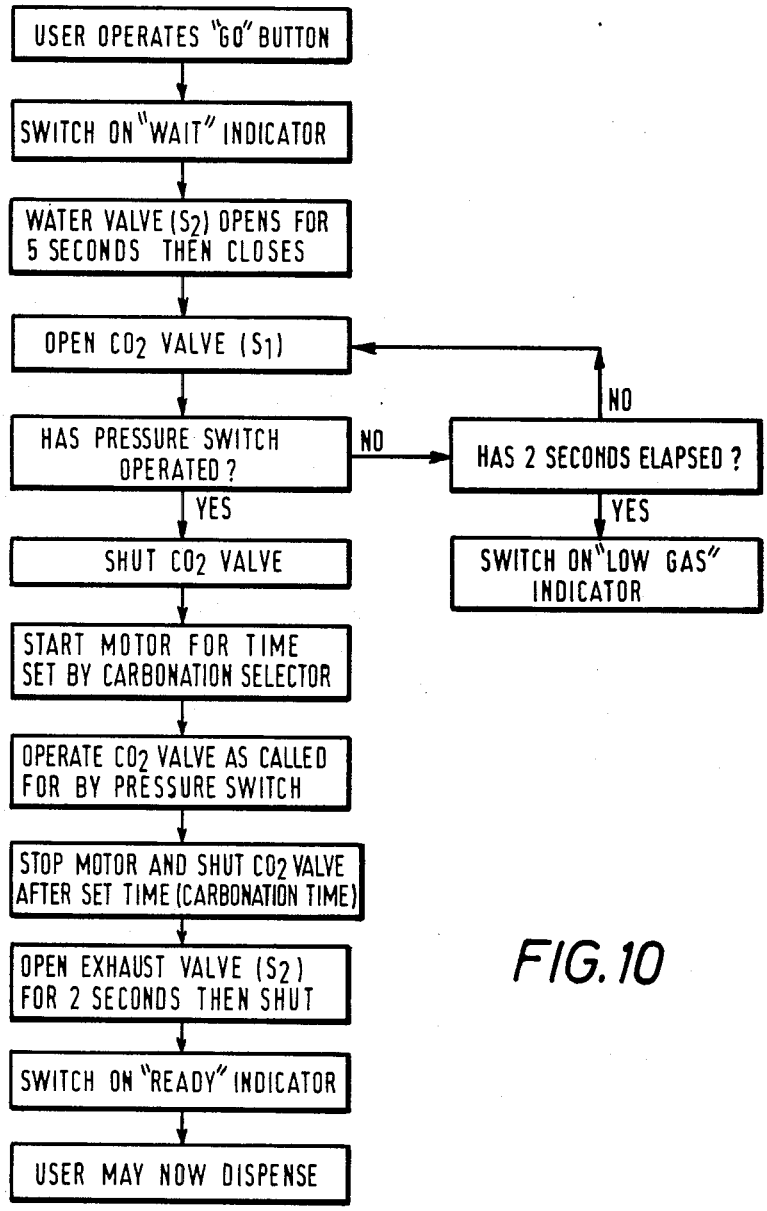
FIG. 10 is a flow chart illustrating in outline a programme followed by the controller unit of FIG. 8.

With reference to FIG. 8, a microprocessor controlled controller unit 100 receives power from a power supply 102 and has three inputs connected respectively to receive signals from a START button 104, the pressure switch 44 and a carbonation time selector 106. The unit 100 has outputs to the solenoids $S_1$ and $S_2$, to the motor 36 and to three indicators 108, 110 and 112 for respectively indicating that the supply of carbon dioxide gas is low, that the operator of the machine should wait and that carbonation has been completed so that a drink may be dispensed. As seen from FIGS. 8 and 9, upon pressing the START button 104, the WAIT indicator 110 is switched on and the solenoid $S_2$ is energized to open the valve $V_2$ and permit water to flow from the tank 12 into the carbonation chamber 10. At the same time the valve $V_3$ opens but this is of no functional significance at this time. The unit 100 is arranged to maintain the valve $V_2$ open for a period of 5 seconds, the apparatus being designed so that during this time period the rate of flow of water into the chamber 10 is sufficient that at the end of the 5 second period the water is at the required level W. The controller 100 then de-energizes the solenoid $S_2$ so as to close the valve $V_2$ (and also the valve $V_3$). The controller 100 then energizes the solenoid $S_1$ to open the valve $V_1$ and permit carbon dioxide gas to flow into the space above the water in chamber 10. The pressure in this space is continuously monitored by pressure switch 44 and the controller 100 de-energizes solenoid $S_1$ to close valve $V_1$ when the pressure reaches the required level, say 100 psig (6.8 bars). Alternatively, if the pressure has not reached this level within two seconds, the controller 100 de-energizes the solenoid $S_1$ to close the valve $V_1$ and at the same time energizes the LOW GAS indicator 108. The controller 100 then energizes the motor 36 so as to cause the water in the chamber 10 to be carbonated. The time for which the motor 36 is energized is determined by the setting of the carbonation selector 10 according to the degree of carbonation required by the user. As shown in FIG. 9, the carbonation time may vary from 2 to 5 seconds. As also shown in FIG. 9 and in FIG. 10, during the carbonation operation, the pressure switch 44 will from time to time indicate that the pressure in the upper part of chamber 10 has reduced, say by 5 psig (0.3 bars), due to absorption of carbon dioxide in the water. When this occurs, the valve $V_1$ is reopened until the pressure again reaches the required level, say 100 psi. This opening and closing of the valve $V_1$ in response to the pressure switch 44 going off and on may occur several times during the carbonation time.

At the completion of the selected carbonation time, solenoid $S_2$ is again energized, this time to open the valve $V_3$ (although the valve $V_2$ also opens but without any effect) so that the concentrate containers 46, 48 and 50 are pressurized utilizing the gas pressure in the chamber 10. The valve $V_3$ is held open for 2 seconds and is then closed. Thereafter, the controller energizes the READY indicator 112 so that the user may now dispense a drink via the valve unit 18 as previously described.

As will be understood, the quantity of water contained in the chamber 10 is preferably that appropriate for a single drink. By way of example, therefore, the total capacity of the chamber 10 may be ½ fluid ounces (1.27 liters) and the apparatus may be arranged so that 5/6 of this capacity is filled with water (i.e. to the level W) and 1/6 of the capacity is left for containing gas. In this way, about 8 fluid ounces of carbonated water will be made and dispensed each time the machine is operated. It is possible to vary from these figures.

MODIFICATIONS

Figure 11:
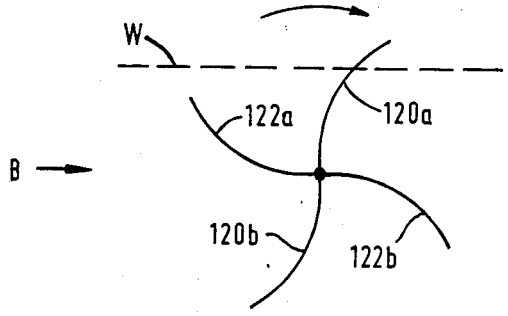
FIG. 11 is a view similar to FIG. 2 showing a modification to the apparatus of FIG. 1.
Figure 12:
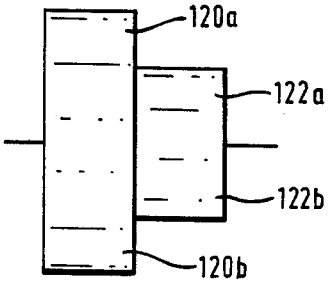
FIG. 12 is a view on the arrow B of FIG. 11.

FIGS. 11 and 12 show a modified form of paddle. In this modification, two pairs of vanes **120*a*, 120*b* and 122*a* and 122*b* are provided. Each of the vanes is, as shown in FIG. 11, curved forwardly in the direction of rotation to assist in ensuring that the gas is efficiently driven down into the water. As seen from FIG. 12, the pair of vanes 120*a* and 120*b* is positioned to one side of the pair of vanes 122*a* and 122*b***.

Figure 13:
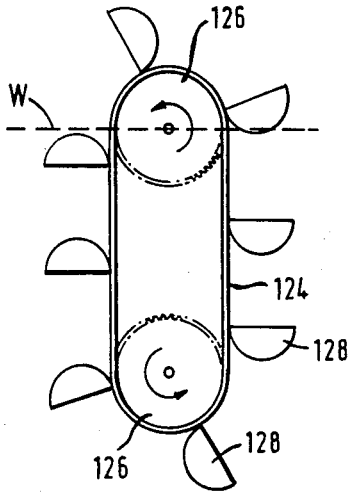
FIG. 13 shows a further modification to the apparatus of FIG. 1.

In the modification of FIG. 13, a belt 124 which is mounted on wheels 126 carries cups 128 so that when the belt is driven by driving one of the wheels 126, the cups 128 collect gas when above the level W and carry that gas down into the water for achieving carbonation.

Figure 14:
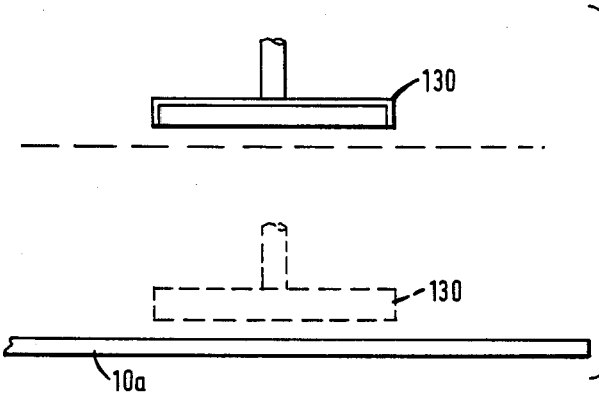
FIG. 14 illustrates yet a further modification.

In the modification of FIG. 14, a reciprocating inverted cup member 130 is provided. This is movable from the full line position above the water level W to the broken line position near to the bottom of the chamber 10 so as to carry gas down into the water for carbonation purposes, when the member 130 is reciprocated vertically.

Various other modifications are possible within the scope of the invention. For example, the carbonation method described may be utilized in a variety of different forms of the apparatus independently of the concentrate dispensing arrangement and the particular valve unit 18 which have been illustrated. Also, the concentrate dispensing arrangement illustrated may be used with other forms of carbonation apparatus and other forms of selector valve means. The selector valve means illustrated may also be used with other forms of carbonation apparatus and other arrangements for supplying concentrate.

As examples of further modifications, it is possible to vary the timing of the operations. For example, it is possible to arrange that the motor 36 be energized before the pressure in the chamber 10 has reached the level set by the pressure switch 44. With this modification, carbonation may begin as soon as the admission of carbon dioxide to the chamber 10 starts.

As a further modification, means other than that illustrated in FIGS. 4 and 5 may be provided for relieving the pressure in the chamber 10 before discharging carbonated water; or the apparatus may be constructed so that discharge of the carbonated water takes place under pressure.

Further, adjustable means, such as valves, may be provided in conduits 58, 60, 62 for controlling or varying the amount of concentrate supplied instead of providing the conduits with different bores as described.

FURTHER EMBODIMENT

The carbonation apparatus shown in FIG. 16 comprises a carbonation chamber 200 which is connected to a water reservoir 202 at 204. A carbon dioxide bottle 206 is connected to the chamber 200 through a valve arrangement 208 and a gas supply pipe 210. A valve 212 is mounted at the bottom of the chamber 200 for discharging carbonated water and a selected concentrate from any one of the concentrate bottles 214, 216 and 218 which are connected to the valve 212 via concentrate supply lines 220. The concentrate bottles 214, 216 and 218 may be pressurised by carbon dioxide from the chamber 200, following a carbonation operation. For this purpose, the bottles 214, 216 and 218 are connected to the chamber 200 through a gas line 222, the valve arrangement 208 and the gas line 210.

The carbonation chamber 200 contains a rotor 224, which comprises a cylindrical body 226 and six radial vanes 228. The rotor 224 is mounted for rotation about a horizontal axis and functions in the same way as the rotor 32 described with reference to FIGS. 1 and 3 to drive carbon dioxide in gaseous form from a carbon dioxide atmosphere above the water level down into the water to carbonate the water. Rotor 224 is supported in a drive shaft 225 which is driven by a motor 230 mounted outside the chamber 200. The chamber 200 also contains a valve 232 for controlling the flow of water from the reservoir 202 into the chamber 200. In FIG. 16, the valve 232 is shown in the fully closed position which it assumes when the chamber 200 has been filled with water to the level W and has been pressurised, in preparation for a carbonation operation, with gas from the supply bottle 206. A seal 233 prevents water leaking along the shaft 225. L and D shown in FIG. 16 indicate the same features as in FIG. 2 and should have the same relationship.

The valve 232 comprises a cylindrical sleeve 234 which fits closely within but is movable relative to a cylindrical boss 236, a disk shaped body 238 and a downwardly projecting stem 240 which may engage the bottom of the chamber 200 to limit downward movement of the valve. A peg 242 integral with the inside of the boss 236 engages in a slot 244 in the sleeve 234. The shape of the slot 244 can be seen in FIGS. 18 to 21.

Figure 18:
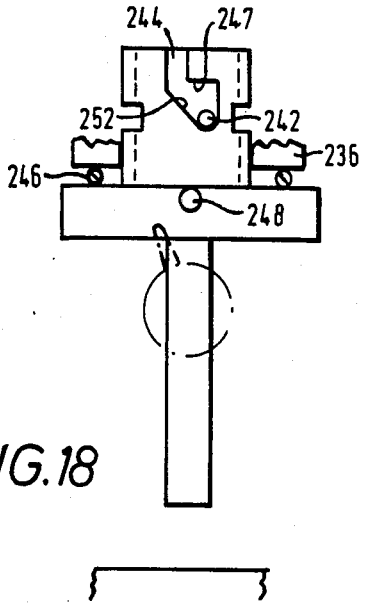
FIGS. 18 to 21 show a water inlet valve for the carbonation chamber of FIG. 16, in four positions.
Figure 19:
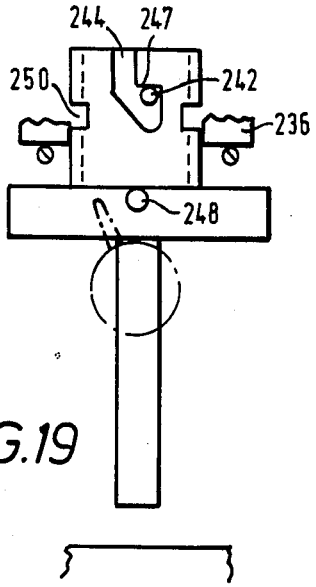
Figure 20:
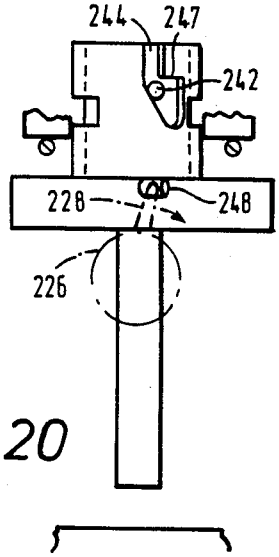
Figure 21:
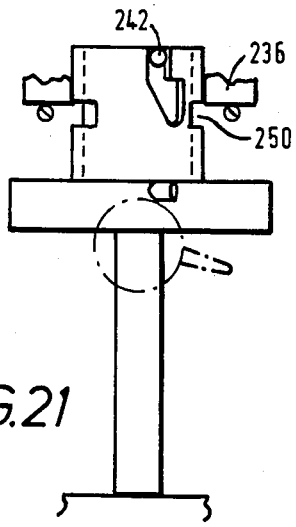

FIGS. 18 to 21 show the positions which the valve 232 assumes during operation of the apparatus. In FIG. 18, the valve is shown in the same position as in FIG. 16 and in this Figure it can be seen that the valve is in its uppermost position which is such that an O-ring 246 is compressed between the body 238 of the valve and the lower end surface of the boss 236 to form a gas tight seal. In this position, the peg 242 is located in the lowermost portion of the slot 244. As already stated, the valve 232 assumes the position shown in FIGS. 16 and 18 when the chamber 200 is pressurised with carbon dioxide. After completion of a carbonation operation, when the chamber 200 is depressurised, the weight of water on the valve 232 causes it to move downwardly from the position shown in FIG. 18 to that shown in FIG. 19 in which a horizontal abutment 248 provided in the wall of the slot 244 rests on the peg 242 and thus prevents further downward movement of the valve 232. In the position shown in FIG. 19, the valve is still closed so that water is prevented from entering the chamber 200 from the reservoir 202 (although it should be understood that a small amount of leakage may arise). The valve may be opened by rotating it about a vertical axis from the position shown in FIG. 19 to that shown in FIG. 20 in which the abutment surface 248 is clear of the peg 242. This rotation is achieved by causing the rotor 224 to be momentarily rotated so that a portion **228*a* of one of the vanes 228 engages a further peg 248 projecting from the side of the disk shaped body 238. This engagement is shown in FIG. 20. After the valve 232 has been rotated to the position shown in FIG. 20, it may fall further under the weight of water until the stem 240 engages the bottom of the chamber 200 as shown in FIG. 21. In this position, the slot 244 and further slots 250 in the sleeve 234 are located below the boss 236 so that water may flow into the chamber 200** through these slots.

As the water approaches the level W, the valve 232 is caused to float upwardly until it returns to the position shown in FIG. 20 at which time the water supply is again cut off. Thereafter, carbon dioxide under pressure is introduced into the chamber 200 and the valve 232 is forced back to the position shown in FIG. 18. During its movement from the position shown in FIG. 20 to that shown in FIG. 18, an inclined surface 252 in the slot 244 engages the peg 242, thereby causing the valve 232 to rotate so that the peg 242 is again located in the lowest part of the slot 244 which, as shown in FIG. 18, is below the abutment surface 248.

Figure 22:
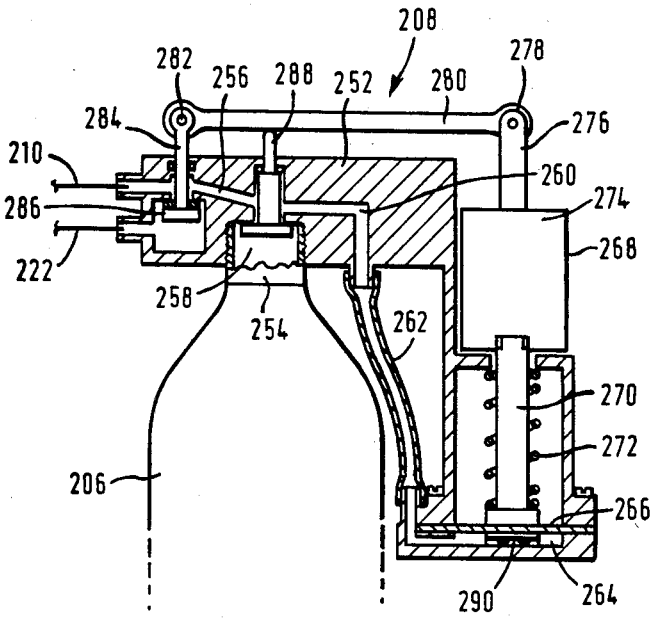
FIG. 22 shows a section through a carbon dioxide control valve arrangement mounted on a carbon dioxide supply bottle.

The valve arrangement 208 is novel and is shown in more detail in FIG. 22. It comprises a body 252 having a cap arrangement 254 which is secured by conventional means (not shown) such as screw threads to the carbon dioxide bottle 206. A conventional means (not shown) is provided to enable the valve arrangement 208 to be connected to the bottle 206 to put the interior of the bottle 206 into communication with the valve arrangement 208 without significant loss of carbon dioxide gas when the connection is made.

The body 252 contains a passage 256 which communicates via a valve 258 with the interior of the bottle 206. The gas supply pipe 210 is connected to the passage 256 so that when the valve 258 is opened carbon dioxide gas from the bottle 206 may be supplied to the carbonation chamber 200. The passage 256 is also connected via a passage 260 and a pipe 262 to a pressure sensing chamber 264 one wall of which is constituted by a diaphragm 266. A solenoid 268 has its coil 274 secured to a rod 270 of which the lower end engages the upper surface of the diaphragm 266 and which is biassed downwardly by a compression spring 272. The armature (not shown) of the solenoid 268 is connected by a rod 276 to one end 278 of a lever 280. The opposite end of the lever 280 is connected by a pivot 282 to a stem 284 of a valve 286 which is located in the body 260 to place the gas pipes 210 and 222 in communication with each other when open. The valve 258 has a stem 288 which abuts the lever 280 at a position intermediate its ends. A pressure sensitive switch, constituted by electrical contacts 290 diagrammatically shown in FIG. 22, is provided so as to give an electrical signal in response to the pressure in the chambers 264 reaching a value which is sufficiently high to raise the diaphragm 266.

The valve arrangement 208 is such that when the solenoid 268 is energized, the rod 276 is drawn downwardly to cause the lever 280 to pivot about the pivot 282 thereby opening the valve 258 to permit carbon dioxide gas to be supplied to the carbonation chamber. The strength of the spring 272 is such as to ensure that when the solenoid is energized the rod 276 is drawn downwardly rather than the rod 270 being drawn upwardly against the force of the spring 272. The pressure in the carbonation chamber 200 is sensed by the diaphragm 266 and when this pressure has reached a level sufficient for the carbonation operation to begin, for example 100 psig (6.8 bars), the diaphragm 266 is raised. Also the pressure sensitive switch 290 opens to give a signal indicating that the required pressure level has been reached. The upward movement of the diaphragm 266 raises the whole of the solenoid 268 so that the lever 280 is pivoted upwardly about the pivot 282 and the valve 258 closes under the action of the gas pressure in the bottle 206 and the force of the stem 288 against the lever 280 holds the valve 286 in its closed position. The carbonation operation may now begin and, as carbon dioxide is absorbed into the water in the carbonation chamber 200, the pressure in the chamber 200 will decrease to some extent, permitting the diaphragm 266 to move downwardly so that the valve 258 is again opened. A balanced condition will be reached at which the valve 258 is just sufficiently open to maintain the required pressure in the carbonation chamber 200 during the carbonation operation.

After carbonation has been completed, the solenoid 268 is de-energized. Thereafter, the pressure in the carbonation chamber 200, the gas supply pipe 210 and the passage 256 is sufficient to open the valve 286 so as to pressurize the concentrate supply containers 214, 216, 218. A pressure relief valve (not shown) limits the pressure in the containers 214, 216 and 218 to about 2 psig (0.1 bars). Valve 286 acts as a non-return valve ensuring pressure in the containers 214, 216 and 218 is not lost when the chamber 200 is emptied.

The valve arrangement 208 is particularly simple and economic to construct and therefore advantageous, particularly as only a single solenoid is needed.

As with the previously described embodiments, carbonation is achieved in the embodiment under description by causing the rotor 224 to be driven so that the vanes or blades 228 move continuously and repeatedly between the water in the chamber 200 and the carbon dioxide atmosphere which is formed above the water so as to drive carbon dioxide from the atmosphere down into the water. Actuation of the motor 230 to start the carbonation operation is achieved in response to the signals from the pressure sensitive switch 290.

Figure 23:
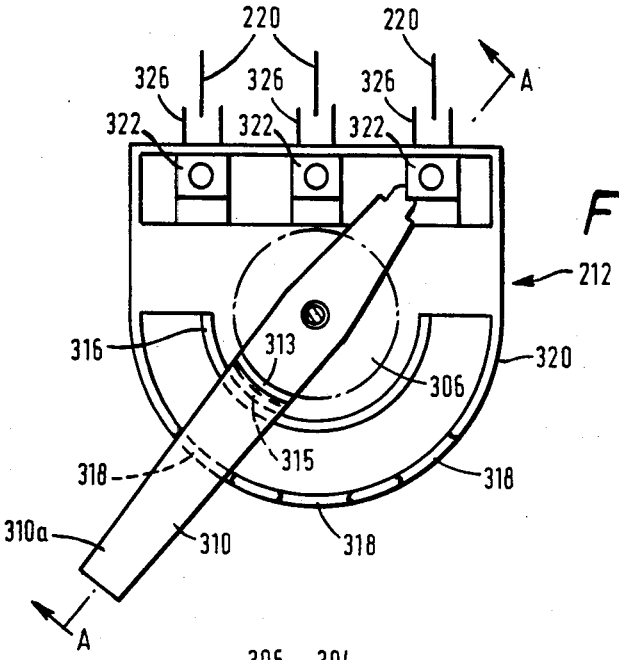
FIG. 23 is a diagrammatic plan view of a valve arrangement for selecting concentrate and for discharging carbonated water from the carbonation chamber.
Figure 24:
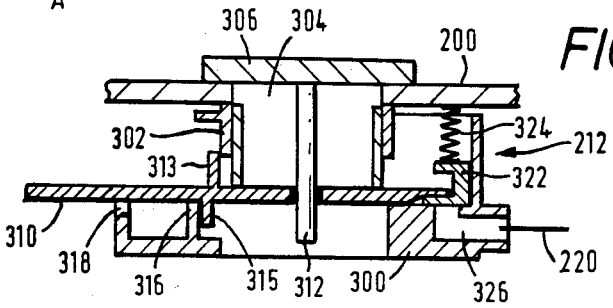
FIGS. 24 and 25 are sections on the line A-A of FIG. 23 and show the valve arrangement in closed and opened positions respectively.
Figure 25:
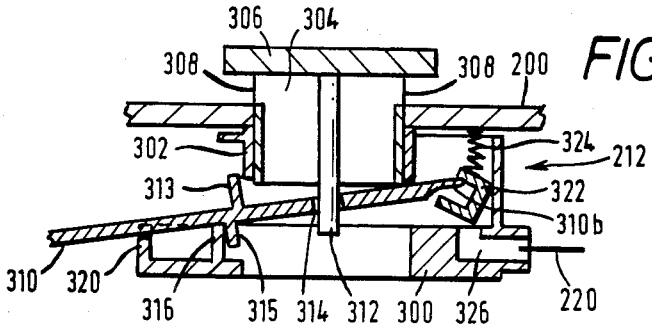

Discharge of carbonated water from the carbonation chamber 200 and selection of the desired concentrate from the containers 214, 216 and 218 is achieved by the valve 212 which is shown in more detail in FIGS. 23 to 25.

The valve 212 comprises a housing 300 which is secured to the underside of the carbonation chamber 200 and includes a sleeve 302 in which a cylindrical valve member 304 is mounted for vertical sliding movement. A valve head 306 is secured to the top of the cylindrical valve member 304 and engages the inside surface of the bottom of the chamber 200 when in the closed position to prevent discharge of water from the chamber 200, this position being shown in FIG. 24. As shown in FIG. 25, the valve member 304 may be raised to its open position in which water may be discharged from the chamber 200 by passing through aperatures 308 and then downwardly through the interior of the cylindrical valve member 304, exiting via the open bottom end of member 304.

An actuating lever 310 is pivotable as shown in FIG. 25 for raising the valve member 304 to the open position. The lever 310 is located in position by a spindle 312 projecting downwardly from the valve head 306 through an aperture 314 in the lever 310. The aperture 314 is sufficiently large relative to the spindle 312 to permit the pivoting movement of the lever 310. An inner arcuate wall 316 provided in the housing 300 acts as fulcrum for the pivoting movement of the lever 310, this pivoting movement being achieved by the operator pressing down on the outer end portion 310*a* of the lever 310. The lever 310 is rotatable in a horizontal plane about the spindle 312 and can be pivoted to the position shown in FIG. 25 at any one of three positions defined by recesses 318 provided in an outer arcuate wall 320 of the housing 300, the outer arcuate wall 320 preventing the pivotal movement of the lever shown in FIG. 25 unless it is in register with one of the recesses 318. Stability is provided to the lever 310 by upwardly and downwardly directed arcuate projections 313 and 315 which respectively engage the outer surface of the sleeve 302 and the inner surface of the arcuate wall 316.

When the lever 310 is in one of the positions defined by the recesses 318, its inner end 310*b* engages a respective one of three concentrate selector valves 322 so that when the lever 310 is pivoted as shown in FIG. 25, the corresponding selector valve 322 is opened against a corresponding spring 324 to permit the corresponding concentrate to flow into the interior of the housing 300 via the corresponding conduit 220 and a corresponding boss 236 associated with the valve 322 for mixing with the carbonated water, the concentrate and the carbonated water falling from the valve arrangement 212 into an appropriate vessel such as a glass 215 (FIG. 15). The concentrate selector and valve arrangement illustrated in FIGS. 22 to 25 is particularly simple and inexpensive to manufacture and has the advantage that the carbonated water tends to wash the valves 322 and their surroundings so that an undesirable build up of stale concentrate may be avoided.

Figure 26:
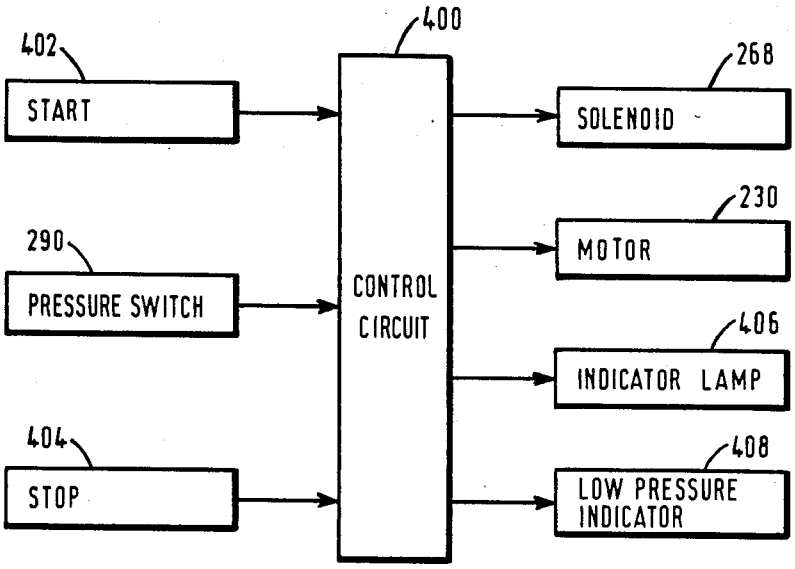
FIG. 26 is a block diagram of the circuitry included in the apparatus of FIG. 15.
Figure 27:
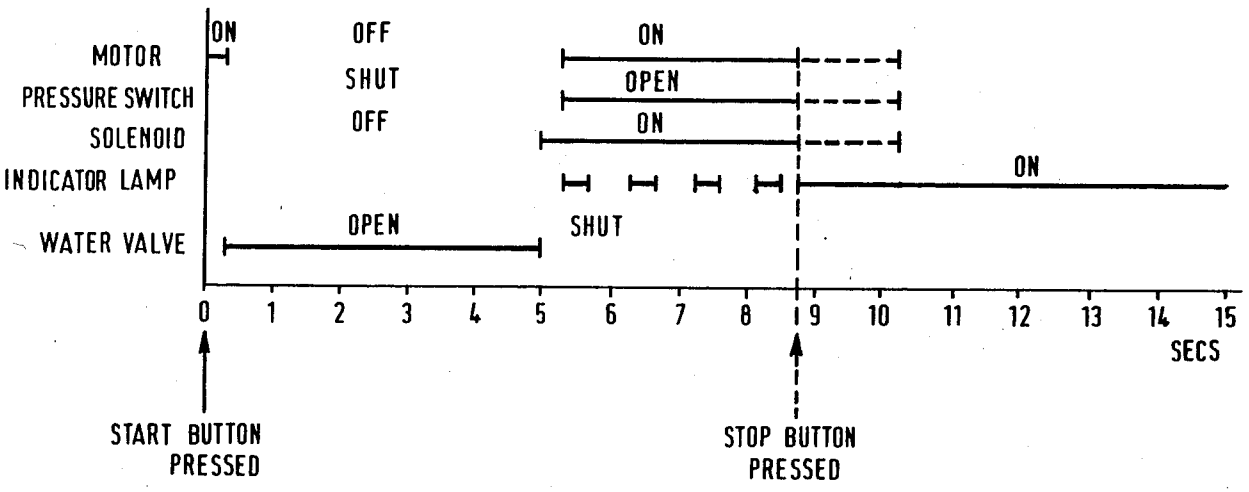
FIG. 27 is a timing diagram illustrating operation of the apparatus of FIGS. 15 to 26.

The embodiment under discussion includes a simplified control arrangement which will be described with reference to FIGS. 26 and 27. The control arrangement comprises a control circuit 400 having as inputs a start button 402, a stop button 404 and the pressure switch 290. The control circuit 400 has four outputs connected respectively to the solenoid 268, the motor 230, an indication lamp 406 mounted on the exterior of the apparatus and a low pressure indicator 408 also mounted on the exterior of the apparatus.

As can be seen from FIG. 25, when the start button 402 is pressed, the motor 230 is momentarily energized to cause the rotor 224 to rotate so that the vane portion 228*a* engages the peg 248 to open the valve 232 and permit water to enter the carbonation chamber 200. The apparatus is constructed so that water flows into the carbonation chamber at a rate which is such that it reaches the required level W by the end of a five second period, this period being timed by the control circuit 400. At the end of this period, the control circuit 400 supplies a signal which causes the solenoid 268 to be turned on to supply carbon dioxide to the carbonation chamber via the valve 258. After a short period, the carbonation chamber reaches the required pressure and in response to this a signal is supplied by the pressure switch 290 to the control circuit 400 which turns the motor 230 on to begin the carbonation operation. If the required pressure is not reached within a predetermined time, the control circuit activates the low pressure indicator 408. The carbonation operation can continue for a maximum period of five seconds which period is timed by the control circuit 400 and begins with the signal from the pressure switch 290. The apparatus is arranged so that the maximum desired degree of carbonation is achieved by the end of the five second period. If, however, the user desires a lower level of carbonation, he can terminate the carbonation operation at any time by pressing the stop button. To assist the operator in determining when to stop the carbonation operation, when he desires a lower level of carbonation, the control circuit 400 causes the indication lamp 406 to flash at intervals during the five second period in which carbonation is taking place. Thus, by counting the number of flashes, the user will have an idea of the level of carbonation achieved. FIG. 27 illustrates an operation in which carbonation was determinated after two flashes of the indication lamp. After the end of the five second carbonation period, the circuit 400 turns the indication lamp on for a period to indicate that carbonation is complete. When the carbonation operation stops, either in response to actuation of the stop button 404 or in response to completion of the five second carbonation period, the circuit 400 de-energizes the solenoid 268 and motor 230. The concentrate containers are then pressurized as previously described and the operator may rotate the lever 310 to the position required to select the concentrate which he wishes to use and then depresses the lever to discharge the carbonated water and the selected concentrate. Of course, if desired, a further recess 318 may be provided in the arcuate wall 320 to permit the operator to discharge carbonated water without any concentrate.

Thus it will be appreciated that the embodiment described with reference to FIGS. 15 to 27 is rather simpler than the earlier described embodiment and may be manufactured more economically. The various numerical data given in connection with the earlier embodiment for speed of rotation of the rotor, gas pressures, etc., may be all applied to the embodiment of FIGS. 15 to 27.

I claim:

1. Carbonating apparatus comprising a carbonation chamber, water supply means for partially filling said carbonation chamber with water to be carbonated therein, said water supply means including water reservoir means connected to said carbonation chamber for supplying water to said carbonation chamber, valve means for controlling said supply of water from said reservoir to said carbonation chamber, gas supply means for providing an atmosphere comprising carbon dioxide above the water in said carbonation chamber, moving means mounted in said carbonation chamber for movement between said atmosphere and said water so as to move carbon dioxide in gaseous form from said atmosphere down into said water to carbonate said water upon movement of said moving means, said moving means being arranged to effect opening of said valve means upon movement of said moving means, and means for causing said moving means to move between said atmosphere and said water.

2. Apparatus according to claim 1 wherein said moving means comprises a rotor including a plurality of vane means projecting therefrom.

3. Apparatus according to claim 2, wherein said rotor has its axis horizontal.

4. Apparatus according to claim 3, wherein said vane means include an outer surface so that upon rotation of the rotor said outer surface of said vane means describes a circle having a diameter D and further wherein L comprises the portion of said vane means portion of the vane projecting above the water level with the rotor stationary, the vane in its uppermost position and the apparatus horizontal, and wherein L is at least 5% of D.

5. Apparatus according to claim 4, wherein L is at least 12% D.

6. Apparatus according to claim 5, wherein L is from 12% to 15% D.

7. Apparatus according to claim 1, including means to vary the time for which said means for moving carbon dioxide is actuated, to vary the degree of carbonation achieved.

8. Apparatus according to claim 1, including means for automatically terminating the operation of said means for moving carbon dioxide after a predetermined time.

9. Apparatus according to claim 8, including manually operable stop means for terminating said operation before the end of said predetermined time.

10. Apparatus according to claim 8, including means for selecting one of a plurality of different said predetermined times, for selecting the degree of carbonation achieved.

11. Carbonation apparatus comprising a carbonation chamber, water supply means for supplying water to said carbonation chamber, carbon dioxide supply means for supplying carbon dioxide to said carbonation chamber at superatmospheric pressure, concentrate supply means for supplying concentrate to a point external to said carbonation chamber for mixing with said carbonated water produced therein, supply means for supplying carbon dioxide from said carbonation chamber to said concentrate supply means for causing the supply of said concentrate from said concentrate supply means, selective isolation means, for selectively isolating said concentrate supply means from said carbonation chamber, whereby said concentrate supply means can be isolated from said carbonation chamber during carbonation of said water therein and carbon dioxide from said carbonation chamber can be supplied to said concentrate supply means subsequent to completion of said carbonation of said water therein.

12. Carbonation apparatus according to claim 11, including pressure relief means communicating with said concentrate supply means for relieving the pressure within said concentrate supply means to a level less than the pressure in said carbonation chamber during carbonation.

13. Carbonation apparatus for carbonating relatively small amounts of water comprising from about six to about 16 ounces of water, said apparatus comprising a carbonation vessel for holding relatively small amounts of water, water supply means connected to said carbonation vessel, control means for controlling said water supply means to cause said water supply means to fill said carbonation vessel with said water to a predetermined water level, said predetermined level being selected so as to leave a space above said predetermined water level, carbon dioxide supply means for forming an atmosphere of carbon dioxide gas in said space at a predetermined elevated pressure of at least about 60 psig, a rotor mounted in said carbonation vessel for rotation about a generally horizontal axis, a plurality of vane means arranged on said rotor so that, upon rotation of said rotor, with said vessel filled to said predetermined water level, said vane means intermittently enters said water and said space above said predetermined water level, a motor operable to cause said rotor to rotate at a speed of at least about 500 r.p.m. to carbonate said water sufficiently to produce carbonated water suitable for making at least one carbonated drink, said motor operable to cause said rotor to rotate for a predetermined period of time on the order of several seconds, and discharge means connected to said carbonation vessel for discharging substantially the entire contents of said carbonation vessel.

14. Carbonation apparatus according to claim 13, wherein said motor is operable to cause said rotor to rotate at a speed of from at least about 1,000 r.p.m.

15. Carbonation apparatus according to claim 13 or 14, wherein said predetermined elevated pressure comprises a pressure of from about 60 psig to about 140 psig.

16. Carbonation apparatus according to claim 13, wherein said predetermined period of time is about five seconds.

17. Carbonation apparatus according to claim 14, or 16, wherein said predetermined elevated pressure is about 100 psig.

18. Carbonation apparatus according to claim 13, wherein if D is the diameter of the circle swept by the tip of the vane upon rotation of the rotor and L is the length of the portion of the vane projecting above the water level with the rotor stationary, the vane in its uppermost position and the apparatus horizontal, L is at least 5% D.

19. Carbonation apparatus according to claim 18, wherein L is at least 12% D.

20. Carbonation apparatus according to claim 19, wherein L is from 12% to 15% D.

21. Carbonation apparatus according to claim 13 or 16, wherein said control means includes means for controlling said carbon dioxide supply means, whereby a carbonation cycle can be controlled by said control means in which said vessel is filled to said predetermined water level while unpressurized, and said carbonation vessel is then pressurized by said carbon dioxide supply means to form said carbon dioxide atmosphere in said space above said predetermined water level.

22. Carbonation apparatus according to claim 13, 14 or 16, further including means to vary the time during which said rotor is rotated to vary the degree of carbonation achieved.

23. Carbonation apparatus according to claim 13, further including means for automatically terminating the operation of said rotor after a predetermined time.

24. Carbonation apparatus according to claim 23, further including manually operable stop means for terminating said operation before the end of said predetermined time.

25. Carbonation apparatus according to claim 23, further including means for selecting one of a plurality of different said predetermined times, for selecting the degree of carbonation achieved.

26. A method for carbonating relatively small amounts of water comprising from about six to about 16 ounces of water in a carbonation chamber, said method comprising the steps of partially filling said carbonation chamber with a relatively small amount of water to a predetermined water level so as to leave a space having a predetermined volume above said predetermined water level, providing an atmosphere of carbon dioxide in said space at a predetermined elevated pressure of at least about 60 psig, providing a rotor including projecting vane means in said carbonation chamber at a predetermined location whereby upon rotation of said rotor at least a portion of said projecting vane means intermittently enters said space and said water, and rotating said rotor at a speed of at least about 500 r.p.m. for a period time on the order of several seconds to produce carbonated water suitable for making at least one carbonated drink.

27. A method according to claim 26, wherein said period of time is about five seconds.

28. A method according to claim 26, wherein said period of time is from two to five seconds.

29. A method according to claim 26, wherein the step of rotating said rotor comprises rotating said rotor at a speed of from at least about 1,000 r.p.m.

30. A method according to claim 29, wherein said predetermined elevated pressure is from at least about 60 psig to about 140 psig.

31. A method according to any of the claims 26 or 27, wherein said predetermined elevated pressure is about 100 psig.

32. Carbonation apparatus for carbonating relatively small amounts of water comprising from about six to about 16 ounces of water, said apparatus comprising a carbonation vessel for holding relatively small amounts of water, water supply means connected to said carbonation vessel, control means for controlling said water supply means to cause said water supply means to fill said carbonation vessel with said water to a predetermined water level, said predetermined level being selected so as to leave a space above said predetermined level, carbon dioxide supply means for forming an atmosphere of carbon dioxide gas in said space at a predetermined elevated pressure of at least about 60 psig, a rotor mounted in said carbonation vessel for rotation about a generally horizontal axis, a plurality of vane means arranged on said rotor, so that, upon rotation of said rotor, with said vessel filled to said predetermined water level, said vane means intermittently enters said water and said space above said predetermined water level, a motor operable to cause said rotor to rotate for several seconds at a sufficiently high speed of rotation to carbonate said water to produce carbonated water suitable for making at least one carbonated drink, and discharge means connected to said carbonation vessel for discharging substantially the entire contents of said carbonation vessel.

33. A method for carbonating relatively small amounts of water comprising from about six to about 16 ounces of water in a carbonation chamber, said method comprising the steps of partially filling said carbonation chamber with a relatively small amount of water to a predetermined water level so as to leave a space having a predetermined volume above said predetermined water level, providing an atmosphere of carbon dioxide in said space at a predetermined elevated pressure of at least 60 psig, providing a rotor including projecting vane means in said carbonation chamber at a predetermined location whereby upon rotation of said rotor at least a portion of said projecting vane means intermittently enters said space and said water, and rotating said rotor for several seconds at a sufficiently high speed of rotation to produce carbonated water suitable for making at least one carbonated drink.

* * * * *